US007418228B2

(12) United States Patent
Domoto et al.

(10) Patent No.: US 7,418,228 B2
(45) Date of Patent: Aug. 26, 2008

(54) FUSER SYSTEMS AND METHODS

(75) Inventors: Gerald A. Domoto, Briarcliff Manor, NY (US); Nicholas P. Kladias, Flushing, NY (US); David H. Pan, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 22 days.

(21) Appl. No.: 11/186,489

(22) Filed: Jul. 21, 2005

(65) Prior Publication Data

US 2007/0020004 A1 Jan. 25, 2007

(51) Int. Cl.
*G03G 15/20* (2006.01)

(52) U.S. Cl. ..... 399/329; 399/328; 399/330; 399/331

(58) Field of Classification Search ..... 399/329–331, 399/328
See application file for complete search history.

(56) References Cited

U.S. PATENT DOCUMENTS

2002/0043531 A1* 4/2002 Uehara et al. ..... 399/330
2004/0042814 A1* 3/2004 Yamada ..... 399/90
2005/0141933 A1* 6/2005 Cho ..... 399/329
2005/0201783 A1* 9/2005 Kurotaka et al. ..... 399/329

FOREIGN PATENT DOCUMENTS

JP 2004246240 A * 9/2004
JP 2005049682 A * 2/2005
JP 2005181474 A * 7/2005

* cited by examiner

*Primary Examiner*—David M. Gray
*Assistant Examiner*—Ryan D Walsh
(74) *Attorney, Agent, or Firm*—Gibb & Rahman, LLC

(57) ABSTRACT

Embodiments use an apparatus comprising a media path that is adapted to transport media sheets within the printing apparatus. Fuser rolls are positioned along the media path, and the fuser rolls are adapted to fuse marking material on the media sheets as the media sheets pass the fuser rolls. A heating belt is positioned to pass a first location between the fuser rolls and to pass a second location separate from the fuser rolls. A heater is positioned in the second location, and the heater is adapted to heat the heating belt. In addition, an iso-thermalizing roller is in contact with the heating belt. In some embodiments, the elements can be positioned in any order. In other embodiments, the elements are positioned such that the heating belt passes the elements in the following order: the heater, the fuser rolls, and then the iso-thermalizing roller.

20 Claims, 10 Drawing Sheets

FUSER SYSTEMS AND METHODS

BACKGROUND

Embodiments herein generally relate to printing apparatus fuser systems and methods. Temperature uniformity across a belt fuser becomes a problem when using thin belts for rapid warm up fusers. In particular, fusing different paper widths presents a problem with portions of the belt outside the paper path becoming too hot. This is normally addressed by using segmented lamps or segmented induction heating coils together with several sensors and controllers for each of the segments.

More specifically, fusing of different media thicknesses and sizes causes problems of fuser overheating outside the paper for narrow media and poor fusing for thick media. The paper size problem is generally addressed by using several heating lamps with widths optimized to several paper sizes. This restricts the allowable paper sizes and also may require run length restrictions and decreased throughput to limit maximum temperature on the fuser surface. Increases in paper thickness may require decreases in throughput or set-point changes which require a large dead time.

SUMMARY

The systems and methods of embodiments herein provide an improved manner in which to prevent overheating and uneven heating of a heating belt for a fuser within a printing apparatus. The embodiments described below incorporate a heat pipe in addition to a separate heater in a belt fusing system to achieve axial uniformity for any paper width and to allow simplified single source heating (uniform width heater that is not segmented). The heat pipe will maintain near isothermal conditions independent of the paper width or the heat input distribution. Thus, no shaping of the heating profile is required and only one sensor and controller would be needed. In embodiments herein, the heat pipe can be made thin with ribs for added structural stiffness. The belt allows separation of the belt heating heat pipe roll from the high pressure fusing nip. The embodiments herein allow for easily replaceable belts.

The embodiments herein use an apparatus comprising a media path that is adapted to transport media sheets within the printing apparatus. Fuser rolls are positioned along the media path, and the fuser rolls are adapted to fuse marking material on the media sheets as the media sheets pass between the fuser rolls. A heating belt is positioned to pass a first location between the fuser rolls and to pass a second location separate from the fuser rolls. A heater is positioned in the second location, and the heater is adapted to heat the heating belt. In addition, an iso-thermalizing roller is in contact with the heating belt. In some embodiments, the elements can be positioned in any order. In other embodiments, the elements are positioned such that the heating belt passes the elements in the following order: the heater, the fuser rolls, and then the iso-thermalizing roller.

A method using these apparatuses transports the media sheets along the media path within the printing apparatus and fuses marking material on the media sheets by transporting the media sheets between the fuser rolls that are positioned along the media path. As mentioned above, in some embodiments, the heating belt can pass the elements in any order. In other embodiments, the elements are positioned such that the heating belt passes the elements in the following order: the heater, the fuser rolls, and then the iso-thermalizing roller.

The passing of the heating belt over the iso-thermalizing roller distributes heat evenly across the heating belt because the iso-thermalizing roller comprises a fluid containing roller that is adapted to evenly distribute heat along its surface. The heater does not need to perform the slow and complicated operation of heating different parts of the heating belt differently. Instead, the heater can comprise a simplified induction-type heater or radiant-type heater uniform heater that applies an even amount of heat to all widths of the heating belt.

The embodiments herein achieve temperature uniformity for any media size and rapid set point changes to accommodate sheet to sheet media thickness variations. The embodiments herein combine rapid induction heating of a belt with a heat pipe for temperature control (uniformity). The embodiments herein are easily scalable to meet a wide speed range.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, fusing of different media thickness and sizes causes problems of fuser overheating outside the paper for narrow media and poor fusing for thick media. The paper size problem is generally addressed by using several heating lamps with widths optimized to several paper sizes. This restricts the allowable paper sizes and also may require run length restrictions and decreased throughput to limit maximum temperature on the fuser surface. Increases in paper thickness may require decreases in throughput or set-point changes which require a large dead time. A belt fuser allows separation of the fusing function from the heating function. With a belt system incorporating two rolls, heating can be accomplished at one of the rolls while fusing can be performed at the other roll. Separation of these functions allows the high pressures required in the fusing nip to be supplied at the fusing roll while the heating can be accomplished at the heating roll where forces are low. The embodiments described below incorporate a heat pipe in addition to a separate heater in a belt fusing system to achieve axial uniformity for any paper width and to allow simplified single source heating.

Figure 1:
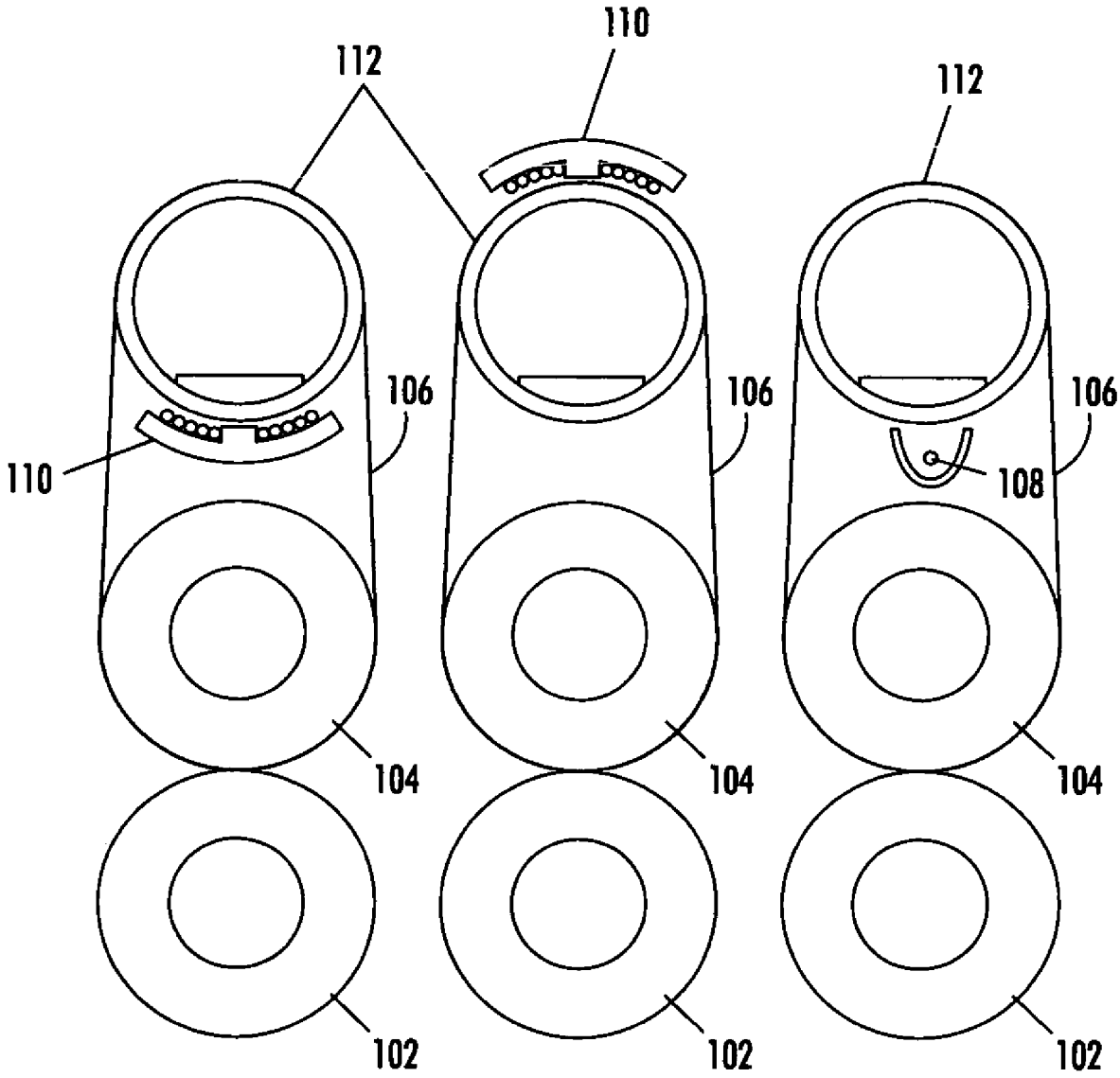
FIG. 1 is a schematic representation of a fuser structures according to embodiments herein.

More specifically, as shown in FIG. 1, fuser rolls (or more technically, a fuser roll 104 and a pressure roll 102) are positioned along the media path, and the fuser rolls 102/104 are adapted to fuse marking material on the media sheets as the media sheets pass between the fuser rolls by applying heat and pressure to the media. A heating belt 106 is positioned to pass a first location between the fuser rolls and to pass a second location (e.g. around a tension roller or heat pipe roll) that is separate from the fuser rolls. A heater 108/110 is positioned in or around the second location, and the heater 108 is adapted to heat the heating belt either indirectly by heating an iso-thermalizing heat pipe roll 112 or directly, as discussed in alternative embodiments below.

The heating source can be either induction heating 110, radiant lamp heating 108, or any other heating means which can supply heating to the roll. The induction heating can be applied to the heat pipe roll material and/or to the belt material. FIG. 1 illustrates three examples where, on the example on the left, the induction heater 110 is positioned below the heat pipe 112. The left example directly heats the heat pipe. The middle example shown in FIG. 1 positions the inductive heater 110 above the heating belt 106 and directly heats the heating belt. The right example uses a radiant lamp 108 to heat the heat pipe 112. One ordinarily skilled in the art would understand that the foregoing are merely three non-limiting examples of how the elements could be positioned, and that the embodiments herein include any and all possible permutations of the foregoing arrangements.

Induction heating is advantageous because of the speed with which it can cycle on and off. Heating of the quartz envelope of a lamp to high temperature (probably substantially above heat roll temperature depending on the radiant energy balance) becomes a limiting factor in reducing warm-up time. The induction heating can be provided by a combination of eddy current losses and magnetic hysteresis losses depending on the composition of the heat roll and belt. Where hysteresis losses are dominant, the maximum temperature can be limited by the Curie temperature of the belt/heating roll material.

The belt and heating roll can be formed of composite materials separating the heat pipe function from the heating function, i.e. a magnetic hysteresis layer may be formed on either the belt and/or heating roll. Since the heat pipe tends to maintain the axial temperature uniformity, axial variations in heating rate can be easily tolerated as the heat pipe spreads the heat evenly across its outer surface. The heat pipe uses the phase change properties of the internal fluid to achieve high effective conductivity. See U.S. Pat. No. 5,689,767, which is fully incorporated herein by reference, for details of heat pipes. The heat pipe promotes the flow of condensed liquid to high heat input areas and flow of evaporated vapor to cooler heat loss areas. The limiting physical phenomena which enter into the design are liquid flow to heat input areas, peak heat flux in boiling over the heat input areas and maximum vapor flow rate to the heat outflow areas of the heat pipe. In one example, water can be used as the working fluid for the heat pipe, although as would be understood, different materials can be used within the heat pipe, depending upon the specific application of the device. If water were used, the peak heat flux in nucleate boiling for liquid-vapor equilibrium at 480 K would be:

$$q_{\max} = 0.149 h_{fg}\rho_v\left(\frac{\sigma g(\rho_1-\rho_v)}{\rho_v^2}\right)^{0.25} =$$

$$0.149\left(1912\frac{\text{kJ}}{\text{kg}}\right)\left(9.0\frac{\text{kJ}}{\text{m}^{3)0}}\right)\left[\frac{36.3\times10^{-3}\left(\frac{N}{\text{m}}\right)9.8\left(\frac{\text{m}}{\text{s}^2}\right)(857-9.01)\left(\frac{\text{kg}}{\text{m}^3}\right)}{9.01^2\left(\frac{\text{kg}}{\text{m}^3}\right)^2}\right] =$$

$$3.56\left(\frac{\text{MW}}{\text{m}^2}\right)^{0.25}$$

For example, if one wanted to provide 1000 Watts of heating, they would need a minimum heat pipe heating surface area of:

$$A_{\min} = \frac{1000\,\text{W}}{3.56\times10^6\frac{\text{W}}{\text{m}^2}} = 0.28\times10^{-3}\text{m}^2 = 2.8\,\text{cm}^2 = 0.434\,\text{in}^2$$

This calculation assumes the heat pipe is rotating fast enough to prevent the un-wetted portions from becoming hotter than the critical temperature required for nucleate boiling. For an estimate of the condensed liquid flow, it will be assumed that there is a level heat pipe and this will determine the difference in liquid height required to produce the requisite liquid flow. For 1000W heat transferred by the heat pipe, at 480 K one would need to have a flow of working fluid of:

$$\text{m} = \frac{Q}{h_{fg}} = \frac{1000\,\text{W}}{1912\frac{\text{kJ}}{\text{kg}}} = 5.23\times10^{-4}\frac{\text{kg}}{\text{s}}$$

A two dimensional approximation of the liquid flow, where the liquid height is the driving force for the flow due to gravity, we obtain the approximate expression for the volume flow per unit width of liquid as:

$$V = \frac{Volumeflow}{\text{width}} = \frac{\rho_{lg}}{12\mu_l L}(h_{left}^4 - h_{right}^4) \text{ or } h_{left}^4 - h_{right}^4 = \frac{12\mu_l LV}{\rho_{lg}}$$

For a width of 1 cm, the required volume flow rate is:

$$V = \frac{\text{m}}{p_l W} = \frac{5.23\times10^{-4}}{857\left(\frac{\text{kg}}{\text{m}^3}\right)0.01\,\text{m}}\left(\frac{\text{kg}}{\text{s}}\right) = 0.61\times10^{-4}\left(\frac{\text{m}^2}{\text{s}}\right)$$

For a length of 0.5 m, the required difference in liquid height is:

$$h_{left}^4 - h_{right}^4 = \frac{12\varpi_l LV}{\rho_{lg}} = \frac{12\left(129\times10^{-6}\frac{Ns}{\text{m}^2}\right)(0.5\,\text{m})\left(0.61\times10^{-4}\frac{\text{m}^2}{\text{s}}\right)}{\left(857\frac{\text{kg}}{\text{m}^3}\right)\left(9.8\frac{\text{m}}{\text{s}^2}\right)}$$

If the liquid height at the right end is assume to be 2 mm the liquid height on the left end is:

$$h_{left} = \sqrt[4]{5.6\times10^{-12} + h_{right}^4} = \sqrt[4]{5.6\times10^{-12} + 16.\times10^{-12}} = 2.15 \text{ mm}$$

The required vapor velocity for 1000 W and a heat pipe diameter of 35 mm is:

$$V = \frac{\text{m}}{p_v A_{cross}} = \frac{5.23\times10^{-4}\frac{\text{kg}}{\text{s}}}{9.01\frac{\text{kg}}{\text{m}^3}\left(\frac{1}{4}\pi(35\times10^{-3}\text{m})^2\right)} = 6.023\times10^{-2}\frac{\text{m}}{\text{sec}}$$

This vapor velocity is far below choked flow conditions and would require very little pressure drop along the length of the heat pipe as well as little drag opposing the liquid flow. Condensation heat transfer would not be a limiting condition for thin liquid layers. Thus, the design of the heat pipe heating roll system requires a large enough heat input area in contact with the liquid to maintain the heating flux below the peak heat flux for nucleate boiling. From the approximate liquid flow analysis, very small liquid height gradients are required for carrying the liquid from the condensing regions to the boiling regions. If heating is to be supplied from one end, then slight tilting of the heat pipe may be desirable. Otherwise, a liquid height of a few mm or such as to wet the entire length within some levelness specification would be sufficient. The vapor flow does not limit the operation of the heat pipe for roll diameters typically used in fusing systems. To assess the effectiveness of the heat pipe in maintaining axial temperature uniformity on the belt surface, a numerical example was implemented based on a 3-dimensional thermal model. Two belt fusers were used: (i) a 0.27 mm thick polyimide belt, and (ii) a 0.001" thick nickel belt. In both cases, an iron heating roll and a heat pipe heating roll were used. The maximum power input to the heating roll was set to 1500 Watts and the temperature set point was 200° C. on the surface of the heating roll. The example was run for warm-up and a 100 copy run at 55 ppm/362 mm/s.

Figure 2:
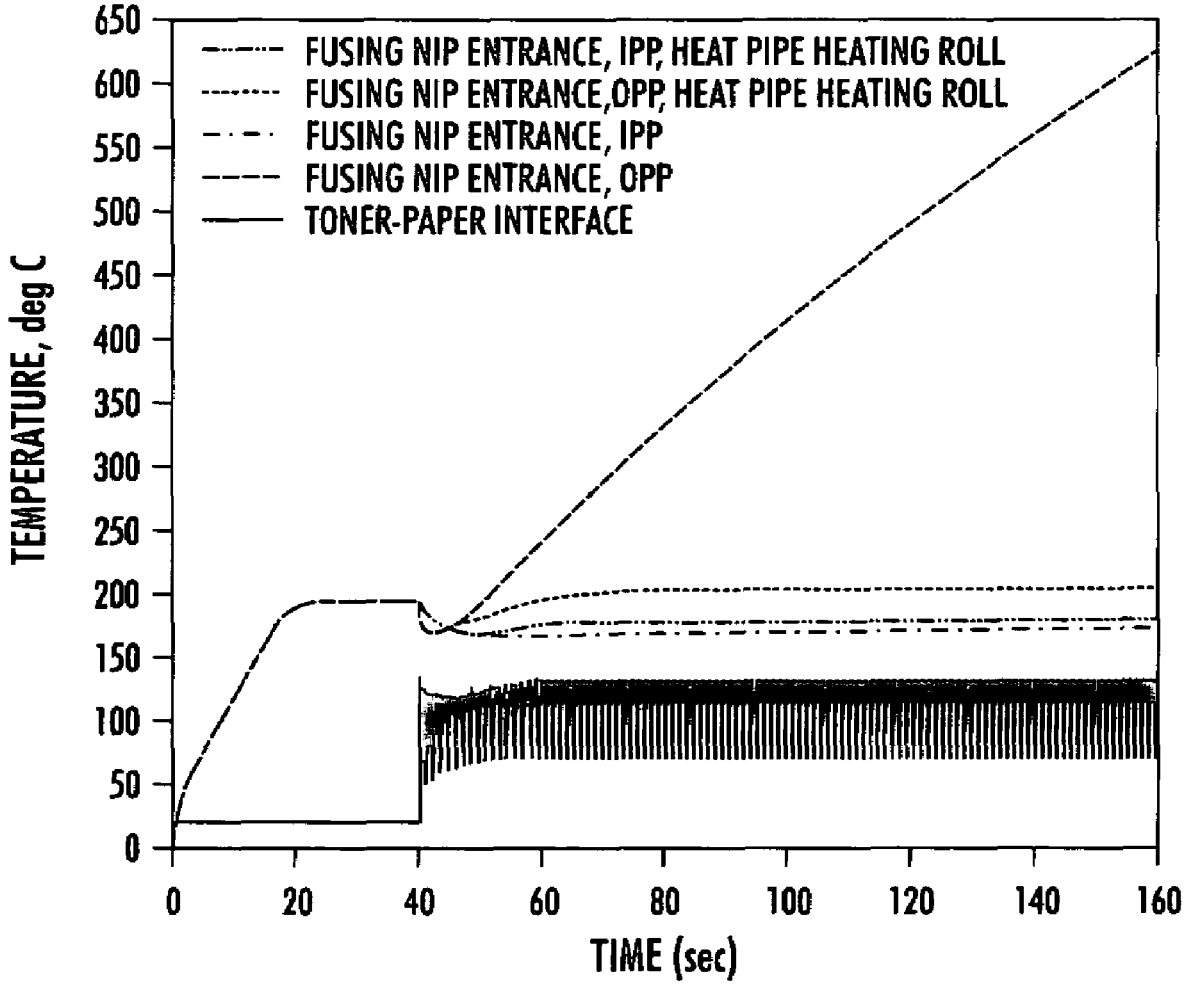
FIG. 2 is a graph showing belt temperatures of fuser structures according to embodiments herein.
Figure 3:
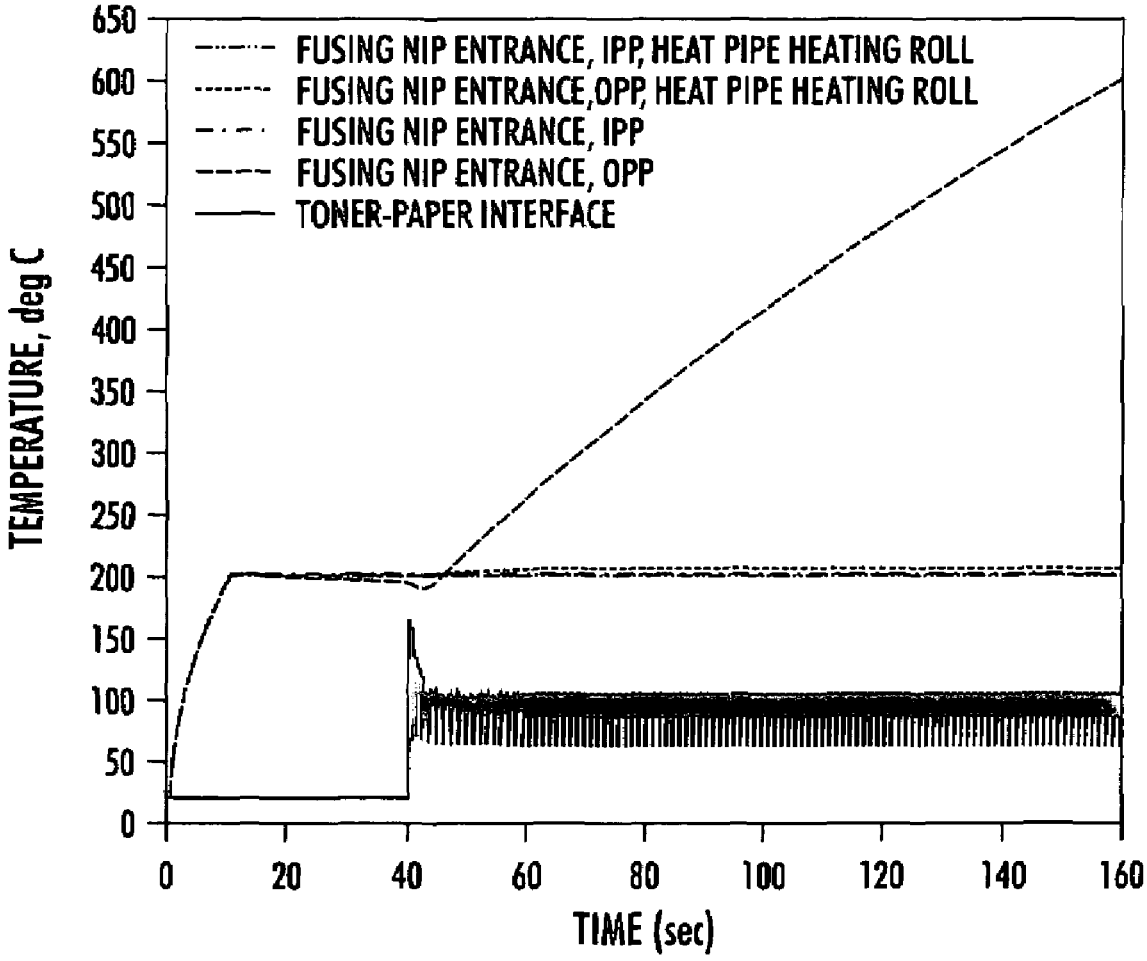
FIG. 3 is a graph showing belt temperature of fuser structures according to embodiments herein.

FIG. 2 shows the polyimide belt temperature at the entrance of the fusing nip both inside the paper path (IPP) and outside the paper path (OPP) as well as the temperature of the toner-paper interface. FIG. 2 shows the nickel belt temperature at the entrance of the fusing nip both inside the paper path (IPP) and outside the paper path (OPP) as well as the temperature of the toner-paper interface. FIG. 2 shows that the 0.27 mm thick polyimide belt heats up to the set point in 20 sec and the toner-paper interface (TPI) temperature is 125° C. In comparison, to achieve the same TPI temperature a fuser roll/pressure roll configuration with a 1.1 mm Aluminum fuser roll would require 27 sec to warm-up. FIG. 3 shows that with using a 0.001" Nickel belt the warm-up time can be reduced to 10 sec.

Figure 4:
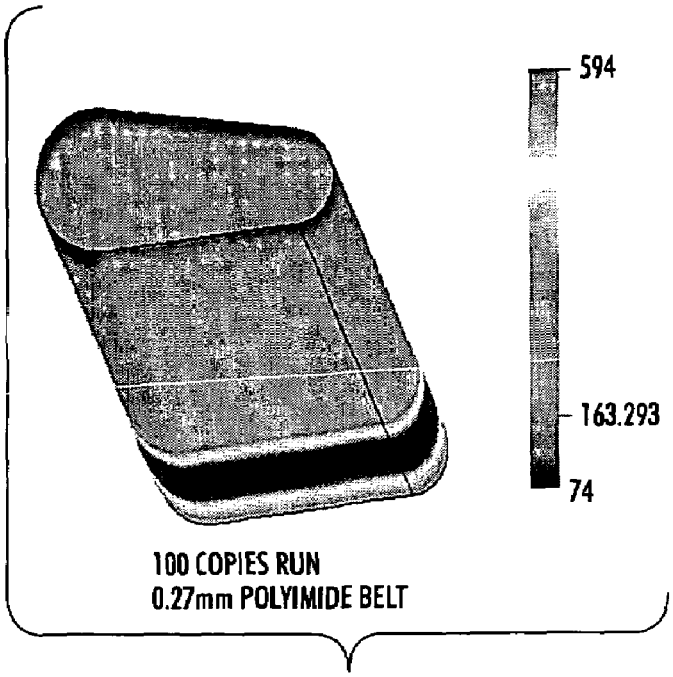
FIG. 4 is a schematic showing belt temperatures of fuser structures according to embodiments herein.
Figure 5:
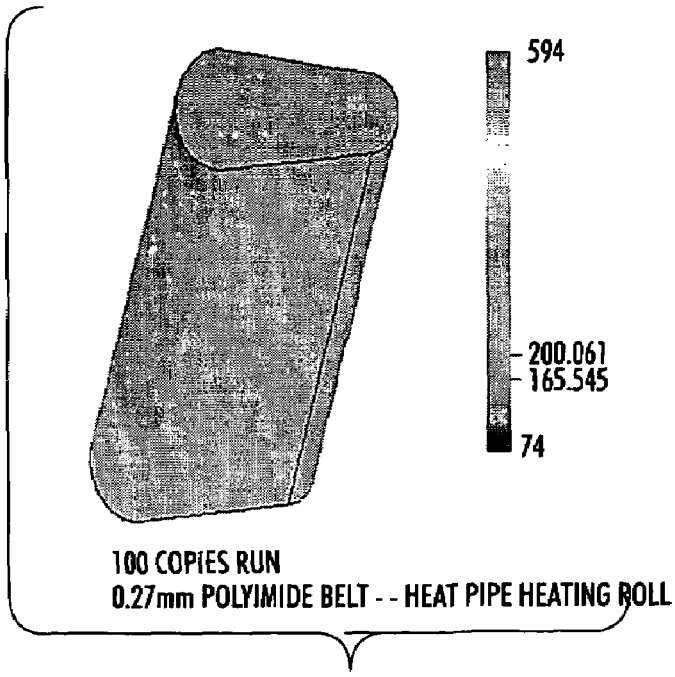
FIG. 5 is a schematic showing belt temperatures of fuser structures according to embodiments herein.

Both FIGS. 2 and 3 show that an iron heating roll with uniform heating would result in a large temperature differential between IPP and OPP (ΔT=450° C. for a polyimide belt and ΔT=380° C. for a nickel belt). However, when a heat pipe heating roll is used, the temperature differential between IPP and OPP is minimized (ΔT=24° C. for a polyimide belt and ΔT=6° C. for a nickel belt). This can also be derived from a three-dimensional plot of the belt surface temperature field presented in FIGS. 4 and 5. FIG. 4 illustrates the fusing belt temperature of the 0.27 mm polyimide belt, iron heating roll and FIG. 5 illustrates the fusing belt temperature of a 0.27 mmm polyimide belt, copper-nickel heat pipe heating roll. The above results of these thermal simulations confirm the effectiveness of the heat pipe in achieving axial temperature uniformity on the belt surface.

Figure 6:
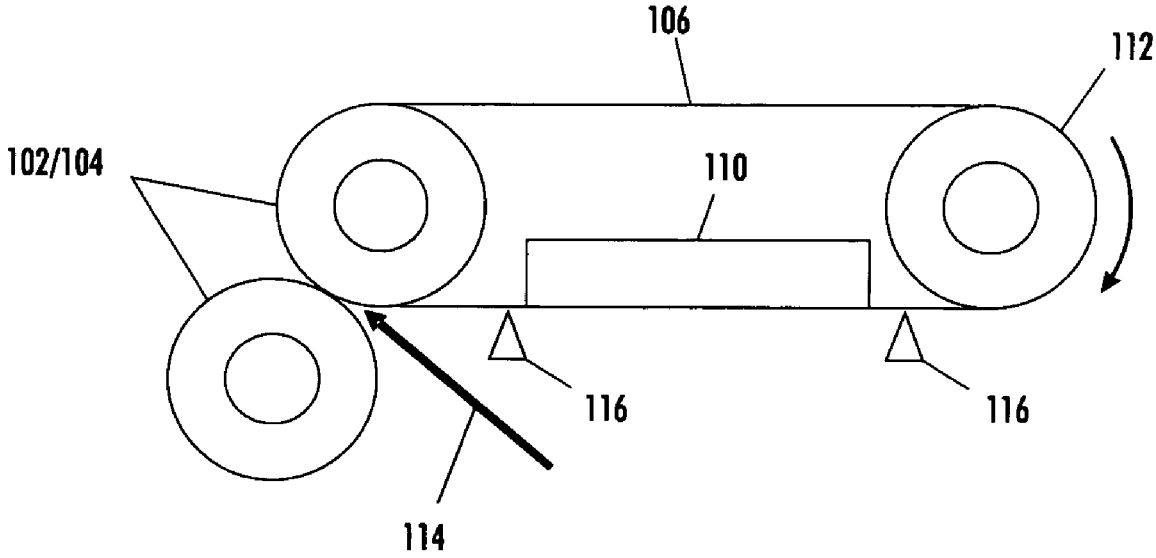
FIG. 6 is a schematic representation of fuser structures according to embodiments herein.

FIG. 6 illustrates another embodiment where the fuser structure incorporates induction heating of the belt separate from the heat pipe iso-thermalizing roll to achieve temperature uniformity for any media size and rapid set point changes to accommodate sheet to sheet media thickness variations. In this example, the induction heating 110 is applied over a section of the free belt 106 just before entering the fusing nip (first location) where the media 114 passes between the fuser rollers 102/104. In addition, temperature sensors 116 are positioned before and after the inductive heater 110 to modulate the operation of the inductive heater 110 and maintain the heating belt 106 within the proper temperature range.

The temperature rise in the induction heating section depends on the power applied, the speed of the belt, the length of the induction heating zone, and the thickness, electrical properties, and heat capacity of the belt. The belt is designed to minimize the time required for changing the belt temperature. The rapidity with which set point changes can be accomplished also depends on the type of controls instituted in the induction heating power supply. The range of possible controllers goes from simple cycle stealing, to pulse width modulation, to frequency modulation. The simplest controllers for induction heating power supplies allow cycle stealing at, for example, 120 hz. If the process speed is 10 ips, and the induction heating zone is 2 inch, the transit time is 0.2 seconds. Thus, in this simplified example, there would 24 cycles during transit through the heating zone. This allows switching between any of 24 power levels within the 0.2 second transit time. Better controls can be instituted by using pulse width modulation which allows 128, 256, or any other number of different power levels. Whichever controller type is used, this fuser allows rapid switching of the temperature set point. The time required for the set point switch is one transit time through the induction heating section.

Figure 7:
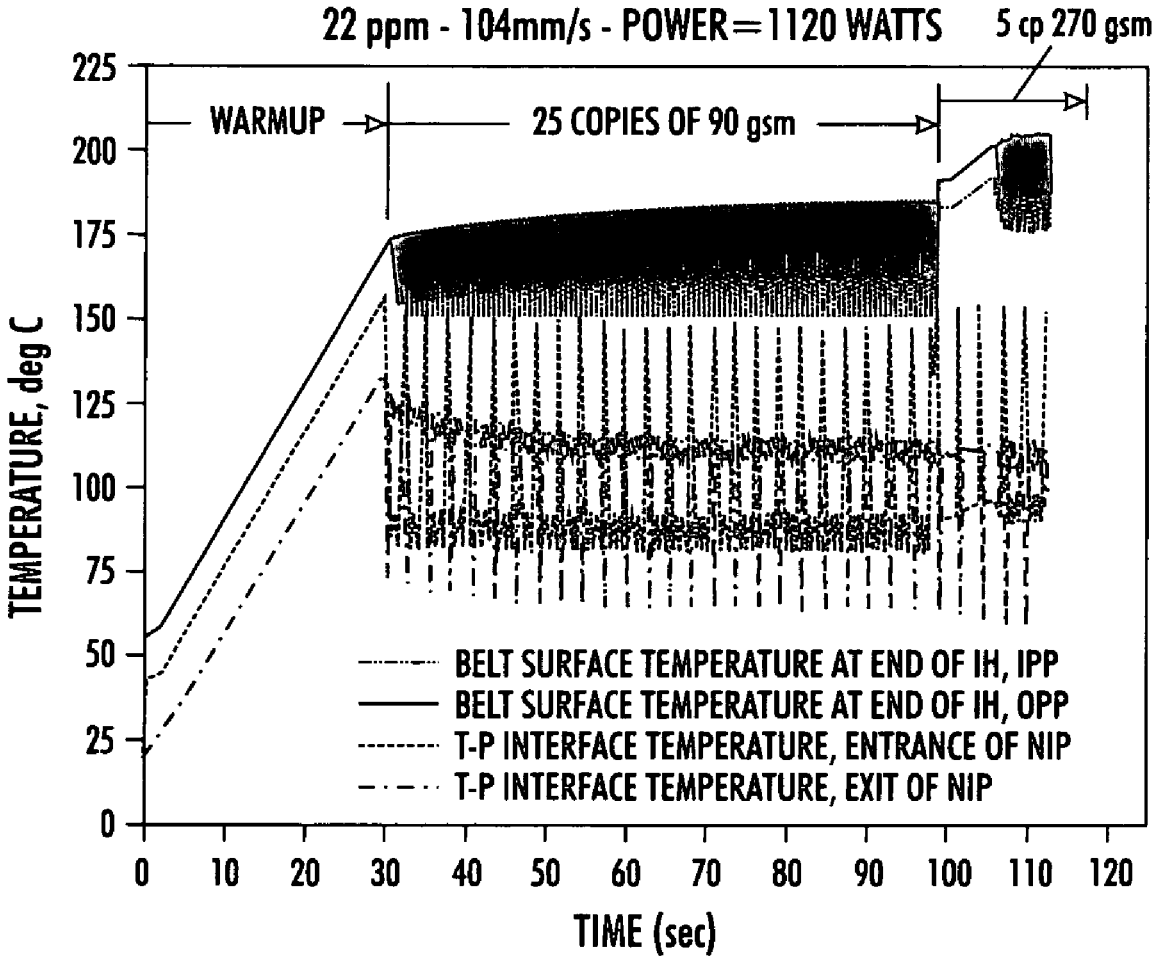
FIG. 7 is a graph showing belt temperatures of fuser structures according to embodiments herein.
Figure 8:
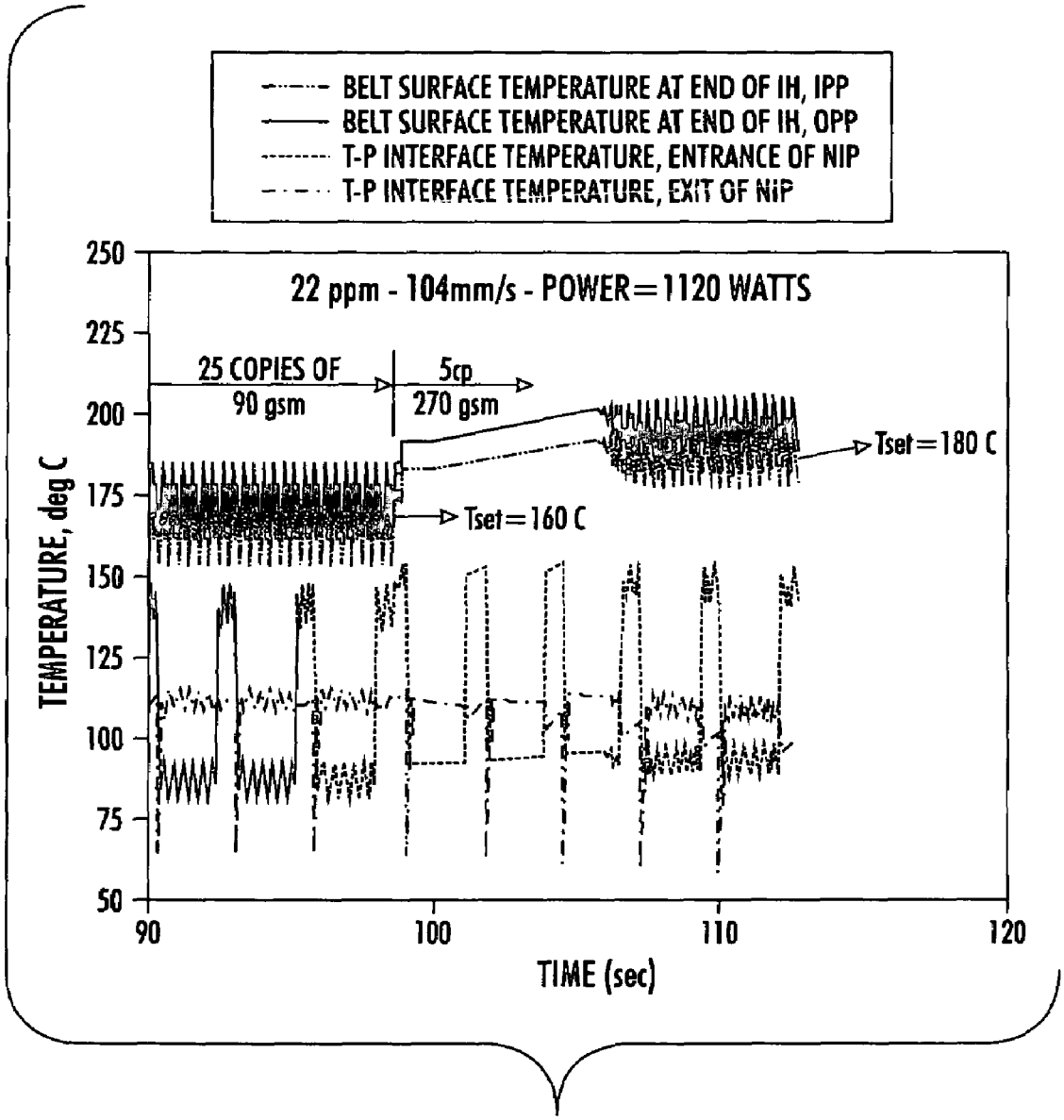
FIG. 8 is a graph showing belt temperatures of fuser structures according to embodiments herein.

Since the transit time is on the order of the inter-copy gap time, this fuser allows page to page variation in the set point when supplied with information regarding the incoming sheet thickness or desired set point for optimal fusing at the rated throughput. Any width of media can be fused with little overheating outside the paper path by using the iso-thermalizing roll. Advantages of embodiments herein include accommodation of thick paper without sacrifice in productivity or the need for large dead time and the prevention of overheating outside the paper path, as demonstrated in FIGS. 7 and 8. FIGS. 7 and 8 illustrates the temperature of the fusing belt inside and outside the paper path at the end of the heating zone and the toner-paper interface temperature at the entrance and exit of the fusing nip as a function of time. FIG. 7 shows the overall temperature vs. time and FIG. 8 illustrates a more detailed plot of set point switch.

More specifically, FIGS. 7 and 8 present the results for a 22 ppm color engine (0.002" thick nickel belt with a 280 micron SiR overcoat). FIG. 7 shows a 30 sec warm-up with a power of 1120 Watts and 25 pages of 90 gsm paper print job which produces a steady state temperature profile. FIG. 7 shows that the belt surface temperature difference between IPP (inside paper-path) and OPP (outside paper path) is limited to 8° C. due to the effect of the iso-thermalizing heat pipe roll (see belt surface temperature curves). Also FIG. 7 shows the results after a 5-page print job of 270 gsm paper immediately after the 90 gsm paper job. The set point is raised to 180° C. from 160° C. in order to achieve the same tone-paper interface temperature (see interface temperature curves). The detailed plot in FIG. 8 shows that the 270 gsm job can be run immediately after the 90 gsm job without the need for dead time. Note that this case is for 1120 watts. Thus, with embodiments herein, higher productivity, shorter warm-up time and shorter switching can be achieved with higher maximum power.

Figure 9:
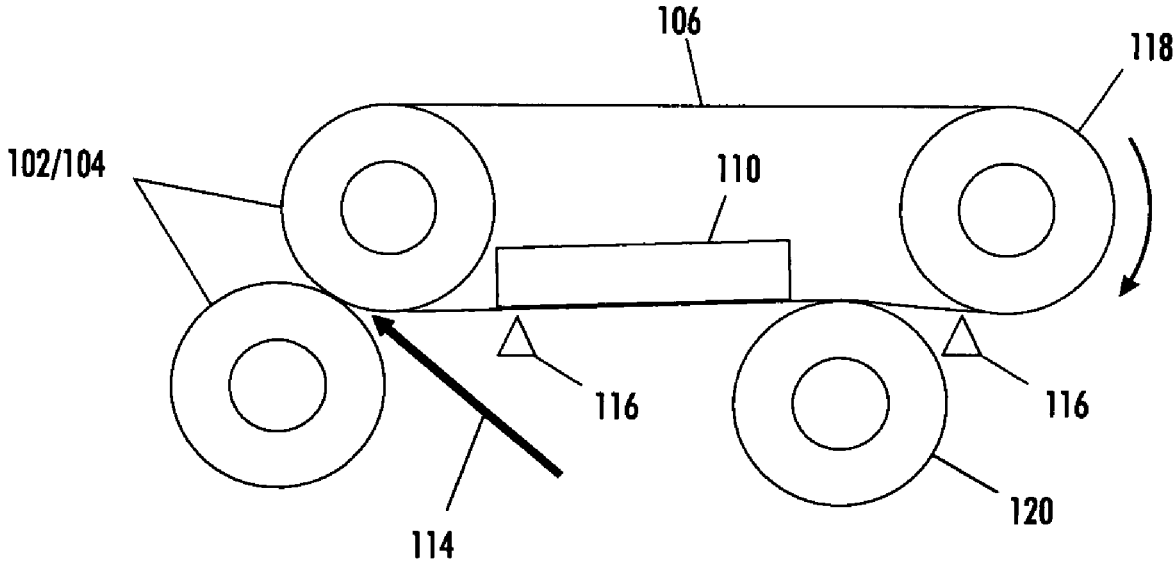
FIG. 9 is a schematic representation of fuser structures according to embodiments herein.
Figure 10:
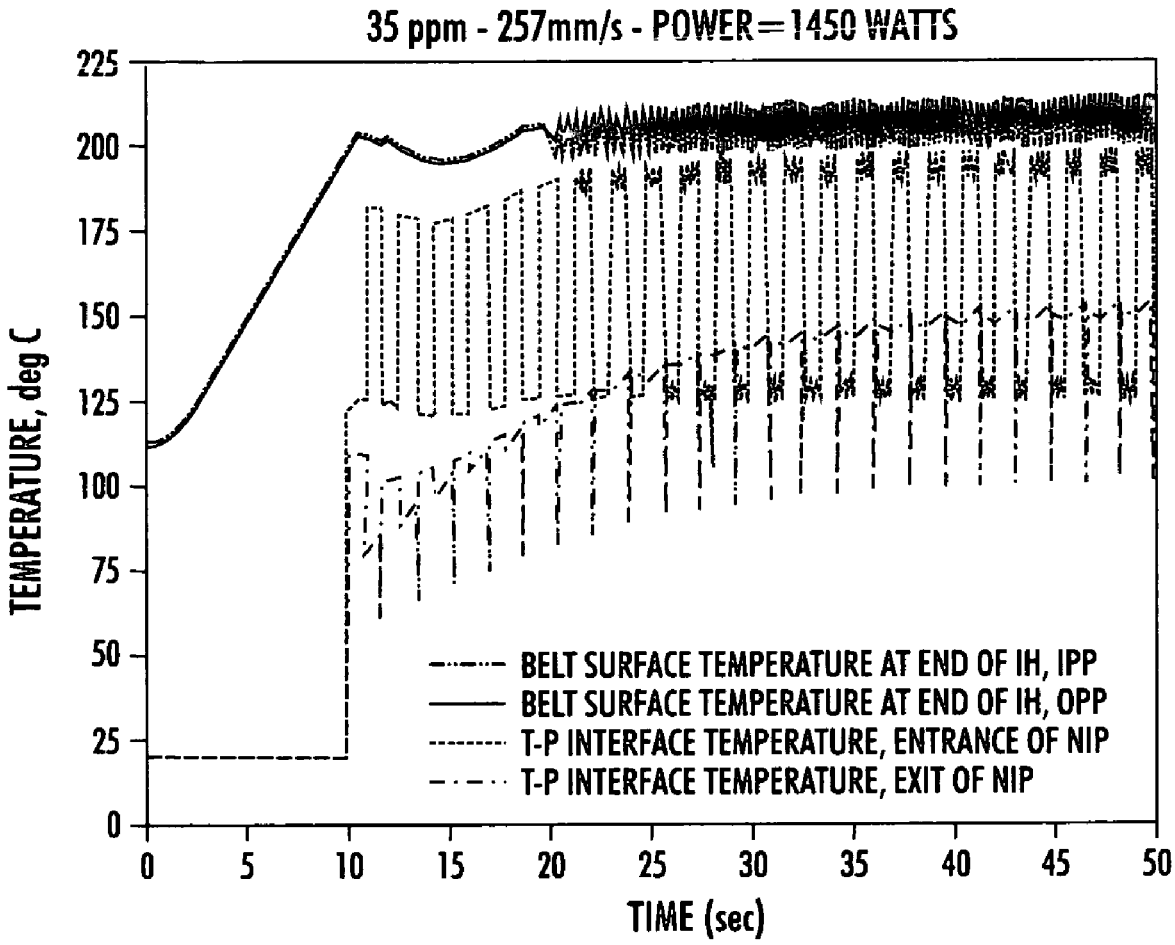
FIG. 10 is a graph showing belt temperatures of fuser structures according to embodiments herein.

To achieve better temperature uniformity in high productivity color engines where the belt features a thick SiR overcoat, an external iso-thermalizing roll 120 may be used as in combination with a tension roll 118 as in FIG. 9. In this embodiment, the elements are positioned such that the heating belt passes the elements in the following order: the heater, the fuser rolls, and then the iso-thermalizing roller. Thick SiR can be filled with thermally conductive filler such as boron nitride and silicon carbide to further increase the heat transfer rate. In addition, a polytetrafluoroethylene (Teflon™) coated metal belt is able to achieve rapid warm-up in the order of 10 sec. This is demonstrated in FIG. 10 which plots temperature vs. time for a 35 ppm black and white engine (0.002" thick nickel belt). FIG. 10 shows that this embodiment can achieve a 10 sec warm-up time with a power of 1450 Watts. Also the belt surface temperature difference between IPP and OPP is limited to 5° C. Teflon belts can also be filled with thermally conductive filler, such as silicon carbide, etc.

Thus, the systems and methods of embodiments herein provide an improved manner in which to prevent overheating and uneven heating of a heating belt for a fuser within a printing apparatus. The embodiments described below incorporate a heat pipe in addition to a separate heater in a belt fusing system to achieve axial uniformity for any paper width and to allow simplified single source heating (uniform width heater that is not segmented). The heat pipe will maintain near isothermal conditions independent of the paper width or the heat input distribution. Thus, no shaping of the heating profile is required and only one sensor and controller would be needed. In embodiments herein, the heat pipe can be made thin with ribs for added structural stiffness. The belt allows separation of the belt heating heat pipe roll from the high pressure fusing nip. The embodiments herein allow for easily replaceable belts.

Figure 11:
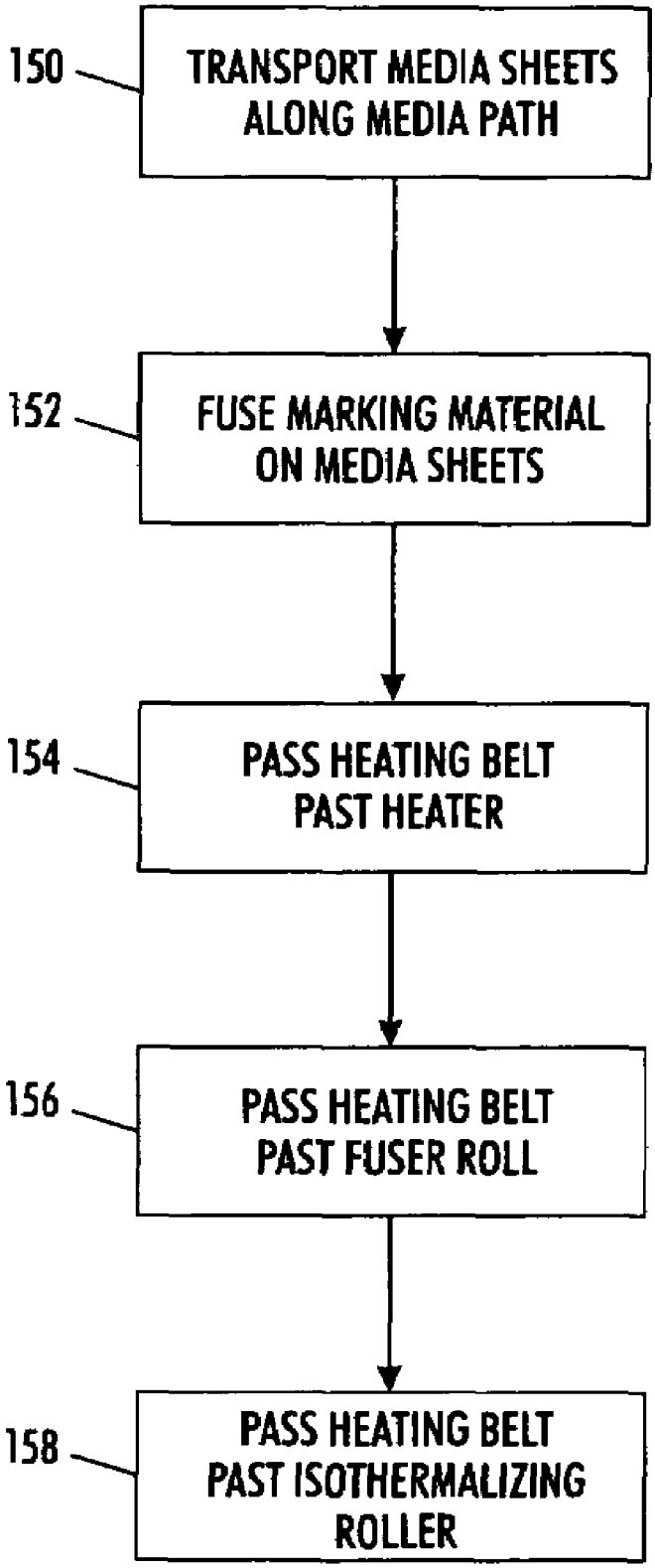
FIG. 11 is a flowchart showing the process flow of embodiments herein.

As shown in flowchart form in FIG. 11, a method using these apparatuses transports the media sheets along the media path (item 150) within the printing apparatus and fuses marking material on the media sheets (item 152) by transporting the media sheets between the fuser rolls that are positioned along the media path. As mentioned above, in some embodiments, the heating belt can pass the elements in any order. In other embodiments, the elements are positioned such that the heating belt passes the elements in the following order: the heater (item 154), the fuser rolls (item 156), and then the iso-thermalizing roller (item 158). This ordering of the elements provides superior heat distribution in the heating belt by placing the iso-thermalizing roller immediately after the fuser, which allows the iso-thermalizing roller to quickly counteract any effects of uneven heat distribution caused by the fuser rolls. The even heating by the heater builds upon this even heat distribution set in place by the iso-thermalizing roller.

The passing of the heating belt over the iso-thermalizing roller distributes heat evenly across the heating belt because the iso-thermalizing roller comprises a fluid containing roller that is adapted to distribute heat along its surface. The heater does not need to perform the slow and complicated operation of heating different parts of the heating belt differently. Instead, the heater can comprise a simplified induction-type heater or radiant-type heater uniform heater that applies an even amount of heat to all widths of the heating belt.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. An apparatus comprising:

a media path having a first side adapted to transport media sheets within a printing apparatus and a second side opposite said first side;

a fuser roll positioned along said first side of said media path, wherein said fuser roll is adapted to fuse marking material on said media sheets as said media sheets pass said fuser roll;

a pressure roll positioned along said second side of said media path at a point opposite said fuser roll such that a nip exists between said fuser roll and said pressure roll;

a heating belt in contact with said fuser roll and positioned within said nip between said pressure roll and said fuser roll;

an iso-thermalizing roll in contact with said heating belt, wherein said iso-thermalizing roll is positioned at a location separate from said nip and separate from areas where said heating belt contacts said pressure roll; and a heater positioned outside said fuser roll and outside said pressure roll, and positioned adjacent said heating belt and away from said iso-thermalizing roll such that said heater is adapted to heat said heating belt and not directly heat said iso-thermalizing roll.

2. The apparatus according to claim 1, wherein said iso-thermalizing roll is adapted to distribute heat evenly across said heating belt.

3. The apparatus according to claim 1, wherein said iso-thermalizing roll comprises a fluid containing roll.

4. The apparatus according to claim 1, wherein said heater is adapted to evenly heat all widths of said heating belt.

5. The apparatus according to claim 1, further comprising a tension roll in contact with said heating belt.

6. An apparatus comprising:

a media path having a first side adapted to transport media sheets within a printing apparatus and a second side opposite said first side;

a fuser roll positioned along said first side of said media path, wherein said fuser roll is adapted to fuse marking material on said media sheets as said media sheets pass said fuser roll;

a pressure roll positioned along said second side of said media path at a point opposite said fuser roll such that a nip exists between said fuser roll and said pressure roll;

a heating belt in contact with said fuser roll, positioned within said nip between said pressure roll and said fuser roll and positioned to pass a second location separate from said nip;

an induction heater positioned outside said fuser roll and outside said pressure roll, and positioned adjacent said heating belt and away from said iso-thermalizing roll such that said induction heater is adapted to heat said heating belt and not directly heat said iso-thermalizing roll; and an iso-thermalizing roll in contact with said heating belt, wherein said iso-thermalizing roll is positioned at a location separate from said nip, separate from areas where said heating belt contacts said pressure roll, and separate from said induction heater, and wherein said iso-thermalizing roll is positioned relative to other elements such that said heating belt passes elements in the following order: said induction heater, said nip, and then said iso-thermalizing roll.

7. The apparatus according to claim 6, wherein said iso-thermalizing roll is adapted to distribute heat evenly across said heating belt.

8. The apparatus according to claim 6, wherein said iso-thermalizing roll comprises a fluid containing roll.

9. The apparatus according to claim 6, wherein said induction heater is adapted to evenly heat all widths of said heating belt.

10. The apparatus according to claim 6, further comprising a tension roll in contact with said heating belt.

11. A method comprising:

transporting media sheets along a media path within a printing apparatus, wherein said media path has a first side adapted to transport said media sheets within a printing apparatus and a second side opposite said first side;

fusing marking material on said media sheets by transporting said media sheets through a nip between a fuser roll positioned along said first side of said media path and a pressure roll positioned along said second side of said media path; and passing a heating belt by a heater, through said nip, and over an iso-thermalizing roll in contact with said heating belt, wherein said iso-thermalizing roll is positioned at a location separate from said nip and separate from areas where said heating belt contacts said pressure roll, and wherein said heater is positioned outside said fuser roll and outside said pressure roll, and positioned adjacent said heating belt and away from said iso-thermalizing roll such that said heater is adapted to heat said heating belt and not directly heat said iso-thermalizing roll.

12. The method according to claim 11, wherein said passing of said heating belt over said iso-thermalizing roll distributes heat evenly across said heating belt.

13. The method according to claim 11, wherein said iso-thermalizing roll comprises a fluid containing roll.

14. The method according to claim 11, wherein said passing of said heating belt by said heater applies an even amount of heat to all widths of said heating belt.

15. The method according to claim 11, wherein said heater comprises one of an induction-type heater and a radiant-type heater.

16. A method comprising:

transporting media sheets along a media path within a printing apparatus, wherein said media path has a first side adapted to transport said media sheets within a printing apparatus and a second side opposite said first side;

fusing marking material on said media sheets by transporting said media sheets through a nip between a fuser roll positioned along said first side of said media path and a pressure roll positioned along said second side of said media path; and passing, in the following order, a heating belt by an induction heater, through said nip, and over an iso-thermalizing roll in contact with said heating belt, wherein said iso-thermalizing roll is positioned at a location separate from said nip, separate from areas where said heating belt contacts said pressure roll, and separate from said induction heater, and wherein said induction heater is positioned outside said fuser roll and outside said pressure roll, and positioned adjacent said heating belt and away from said iso-thermalizing roll such that said induction heater is adapted to heat said heating belt and not directly heat said iso-thermalizing roll, and operating said induction heater in a cyclical manner to heat said heating belt.

17. The method according to claim 16, wherein said passing of said heating belt over said iso-thermalizing roll distributes heat evenly across said heating belt.

18. The method according to claim 16, wherein said iso-thermalizing roll comprises a fluid containing roll.

19. The method according to claim 16, wherein said passing of said heating belt by said heater applies an even amount of heat to all widths of said heating belt.

20. The method according to claim 16, wherein said heater comprises one of an induction-type heater and a radiant-type heater.

* * * * *